US008816873B2

(12) United States Patent
Bisset et al.

(10) Patent No.: US 8,816,873 B2
(45) Date of Patent: Aug. 26, 2014

(54) ENTERTAINMENT APPARATUS FOR A SEATED USER

(75) Inventors: David Lindsey Bisset, Bath (GB); Tristan Alexander Powell, Somerset (GB)

(73) Assignee: Trignom Ltd. (GB)

( * ) Notice: Subject to any disclaimer, the term of this patent is extended or adjusted under 35 U.S.C. 154(b) by 789 days.

(21) Appl. No.: 12/747,560

(22) PCT Filed: Dec. 18, 2008

(86) PCT No.: PCT/GB2008/004183

§ 371 (c)(1), (2), (4) Date: Jun. 11, 2010

(87) PCT Pub. No.: WO2009/081111

PCT Pub. Date: Jul. 2, 2009

(65) Prior Publication Data

US 2010/0265090 A1 Oct. 21, 2010

(30) Foreign Application Priority Data

Dec. 24, 2007 (GB) ..... 0725165.5

(51) Int. Cl.
*G08B 21/00* (2006.01)

(52) U.S. Cl.
USPC ..... 340/686.1; 340/573.1; 340/573.7; 601/84; 84/600

(58) Field of Classification Search
USPC ..... 340/573.1, 573.7; 601/84, 148, 99, 101; 84/674, 600, 615, 622
See application file for complete search history.

(56) References Cited

U.S. PATENT DOCUMENTS 1,661,058 A * 2/1928 Theremin ..... 84/674
3,193,325 A * 7/1965 Wenger ..... 297/186

(Continued)

FOREIGN PATENT DOCUMENTS

DE 29616971 U1 11/1996
GB 2312374 A 10/1997

(Continued)

OTHER PUBLICATIONS

"Penn and Teller Seance Electronics", MIT Media Laboratory, Dec. 1994, 59 pages.

(Continued)

*Primary Examiner* — Brian A. Zimmerman
(74) *Attorney, Agent, or Firm* — Barnes & Thornburg LLP

(57) ABSTRACT

A seat (5) includes a sensor (21) mounted on the seat which is arranged to sense the presence of an object, or movement or position of an object in a non-contact manner, within a sensing region around the seat. A processor is arranged to receive an audio signal and to process the audio signal based on presence, movement or position detected by the first sensor. A processed signal is delivered to a vibro-acoustic transducer mounted within the seat. The processor can also control a lighting effect based on presence, movement or position detected by the first sensor. A user can interact with audio in a personal way, to suit the mood of the user. A seated user can move their body (especially arms or hands) to modify audio, such as music. The seat has a nodule (12) which, in use, fits between the legs of a seated user. The nodule can house the sensor (21) and user controls.

26 Claims, 10 Drawing Sheets

(56) References Cited

U.S. PATENT DOCUMENTS

| | | | | |
|---|---|---|---|---|
| 5,290,964 | A * | 3/1994 | Hiyoshi et al. | 84/600 |
| 5,762,618 | A * | 6/1998 | Yamanaka et al. | 601/148 |
| 6,104,293 | A * | 8/2000 | Rossi | 340/573.1 |
| 6,137,042 | A * | 10/2000 | Kurtzberg et al. | 84/477 R |
| 6,171,266 | B1 * | 1/2001 | Inada et al. | 601/99 |
| 6,204,767 | B1 * | 3/2001 | Sparks | 340/573.1 |
| 6,392,556 | B2 * | 5/2002 | Tomich | 340/689 |
| 6,661,345 | B1 * | 12/2003 | Bevan et al. | 340/575 |
| 2004/0225239 | A1 * | 11/2004 | Yamamoto et al. | 601/84 |
| 2005/0234310 | A1 * | 10/2005 | Alwan et al. | 600/300 |
| 2007/0257530 | A1 | 11/2007 | Florez | |

FOREIGN PATENT DOCUMENTS

| | | | |
|---|---|---|---|
| JP | 59174090 | A | 10/1984 |
| JP | 3283998 | A | 12/1991 |
| JP | 4019697 | A | 1/1992 |
| JP | 6054935 | A | 3/1994 |
| JP | 2001269431 | A | 10/2001 |
| JP | 2004121307 | A | 4/2004 |
| JP | 2006149468 | A | 6/2006 |
| WO | WO-03/001946 | A1 | 1/2003 |
| WO | WO-03/092441 | A1 | 11/2003 |
| WO | WO-2008/094329 | A1 | 8/2008 |

OTHER PUBLICATIONS

Search report in GB0725165.5, May 9, 2008.

Search report in PCT/GB2008/004183, May 20, 2009.

Translation of Office Action in JP 2010-540169, Feb. 1, 2013, 2 pages.

* cited by examiner

ENTERTAINMENT APPARATUS FOR A SEATED USER

FIELD OF THE INVENTION

This invention relates to an entertainment apparatus for a seated user.

BACKGROUND TO THE INVENTION

There is a widespread interest in listening to music for pleasure. Listening to music is usually a passive activity, with a user listening to music in the background as a source of relaxation, often while seated, or as a source of motivation while performing some other task, such as working out.

There have been several proposals to adapt seats to make use of a musical input. Massage chairs, which stimulate a user's body whilst in a seated or lying position, are shown in U.S. Pat. No. 6,027,463 (Moriyasu), U.S. Pat. No. 4,779,615 (Frazier) and DE 20 2005 001862U. All of these are intended to provide relaxation to a passive user. Cinemas and home cinemas have also made use of seats for audience members with dedicated audio speakers to deliver sound from a prerecorded soundtrack of a media item, such as a film or a game. Again, the user passively experiences the prerecorded soundtrack.

The Penn & Teller Sensor Chair (J. Paradiso, MIT Media Lab, 1994, http://web.media.mit.edu/~joep/TTT.BO/chair.html) is a chair which was developed for use in a magic act simulating a séance. A plate on the seat of the chair causes the occupant of the chair to act as a transmitter and a sensor array is mounted in front of the chair. Movement of a user's hands and feet is detected by the array and used to trigger sounds or adjust volume or timbral characteristics of sounds. This chair requires a cumbersome array which was disguised, in the magic act, by a booth but which makes the chair unsuitable for many other applications.

The present invention seeks to provide an interactive experience to a seated user.

SUMMARY OF THE INVENTION

A first aspect of the present invention provides an entertainment apparatus comprising:

a seat;

a first sensor mounted on the seat which is arranged to sense the presence of an object, or movement or position of an object in a non-contact manner, within a sensing region around the seat;

a processor arranged to perform at least one of:

receive an audio signal and to process the audio signal based on presence, movement or position detected by the first sensor to provide a processed signal for output to a transducer;

generate a processed signal for output to a transducer based on presence, movement or position detected by the first sensor;

control a lighting effect based on presence, movement or position detected by the first sensor.

The entertainment apparatus allows a user to interact with audio in a personal way, to suit the mood of the user. The entertainment apparatus also allows a user to control lighting effects, in combination with, or independently of, any manipulation of audio, to suit the mood of the user. Additionally, the entertainment apparatus allows a user to control vibratory effects, in combination with, or independently of, any manipulation of audio or lighting effects, to suit the mood of the user. A seated user can move their body (especially arms or hands) to modify audio, such as music, or to control lighting effects or vibratory effects. The sensing can be achieved without the need for a cumbersome, and impractical, sensing array mounted externally of the seat. It also allows another user to interact with the audio of the seated user, to provide a performance for the seated user. Advantageously, the first sensor makes use of a co-located transmitter and receiver, which further reduces the mounting requirements of sensor parts on the seat. The sensor can be an ultrasonic or infra-red sensor which includes a co-located source of energy (e.g. ultrasonic or infra-red energy) and a detector/receiver, although other types of sensor, such as a camera or thermal sensor can also be used.

The audio signal can be provided by a local media source (e.g. hard-disk or solid-state store, MP3 player, CD player, DVD player) or it can be provided by an external source, such as a DJ's mixing desk, live audio from the audio mixing desk of a band presenting a live performance.

Advantageously, the seat comprises a nodule shaped to cause a user to sit in a position in which their legs are parted around the nodule. The first sensor can be conveniently positioned on (within) the nodule, or substantially vertically aligned with it, such that it can sense in the region which is clear of obstructions in front of the seated user. The first sensor can sense in the region in front of the nodule and/or the region above the nodule. Because the user is forced to sit with their legs parted, this area is free of obstructions, to allow effective sensing. It can also allow another person to move within this region, to vary the effects experienced by the seated user. The nodule is also a convenient place in which to mount the first sensor, or an additional sensor, for sensing in the region above the seat, and the lap of a user.

Preferably, the apparatus comprises a transducer for generating sound and/or vibratory energy which is mounted within the seat. The transducer is advantageously arranged to transmit vibratory energy to a seated user in a tactile manner. This has been found to considerably enhance the experience for a seated user.

The seat can be embodied as a stand-alone unit with the processor mounted within the seat, or seat base. Alternatively, the control unit can be mounted externally of the seat, or at least some of the processing can be performed by a personal computer (PC), with the seat being used as an accessory for the PC.

A further aspect of the invention provides a seat which is suitable for use as part of the apparatus.

BRIEF DESCRIPTION OF THE DRAWINGS

Embodiments of the invention will be described, by way of example only, with reference to the accompanying drawings in which.

DESCRIPTION OF PREFERRED EMBODIMENTS

Figure 1:
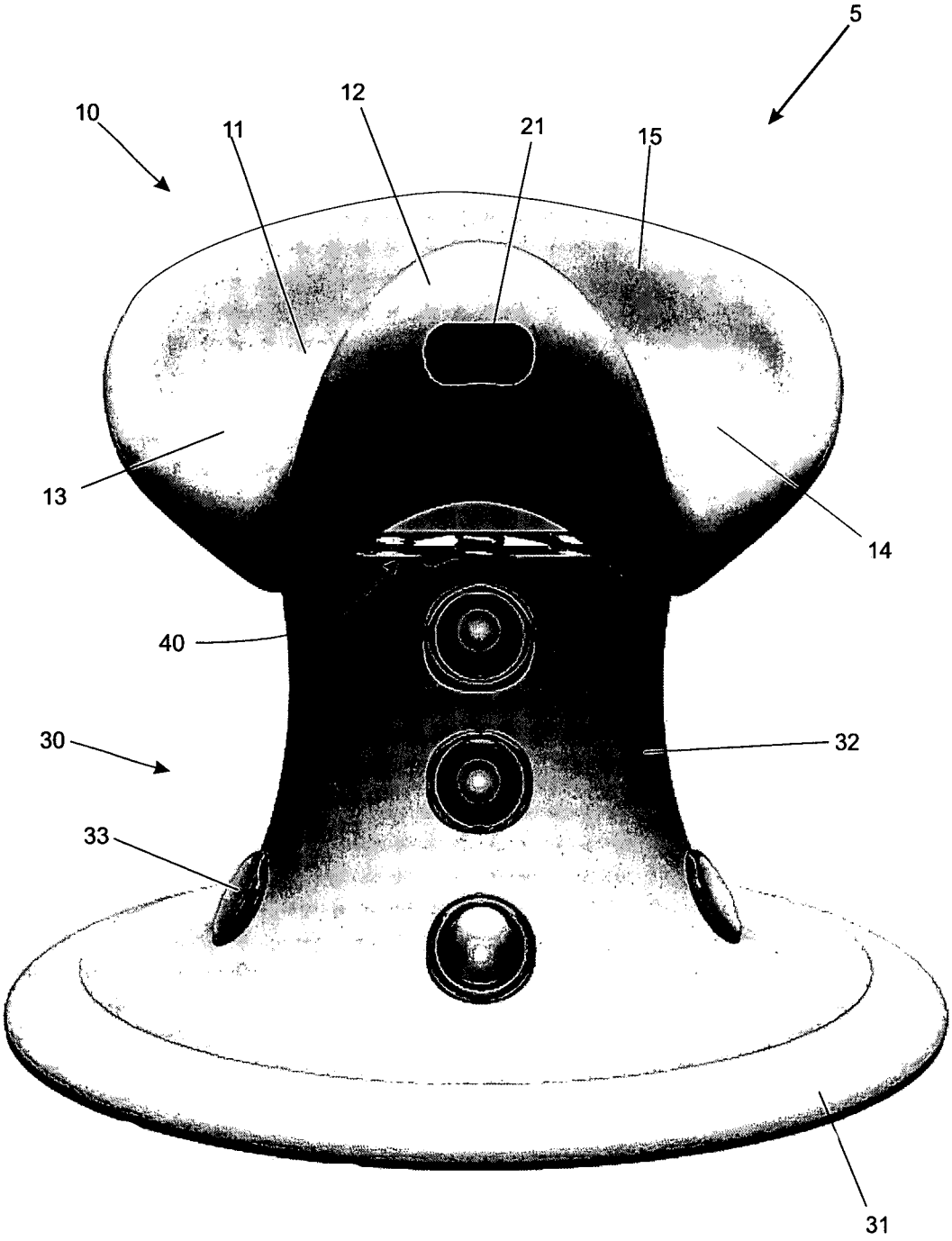
FIG. 1 shows a seat in accordance with a first embodiment of the present invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Figure 2:
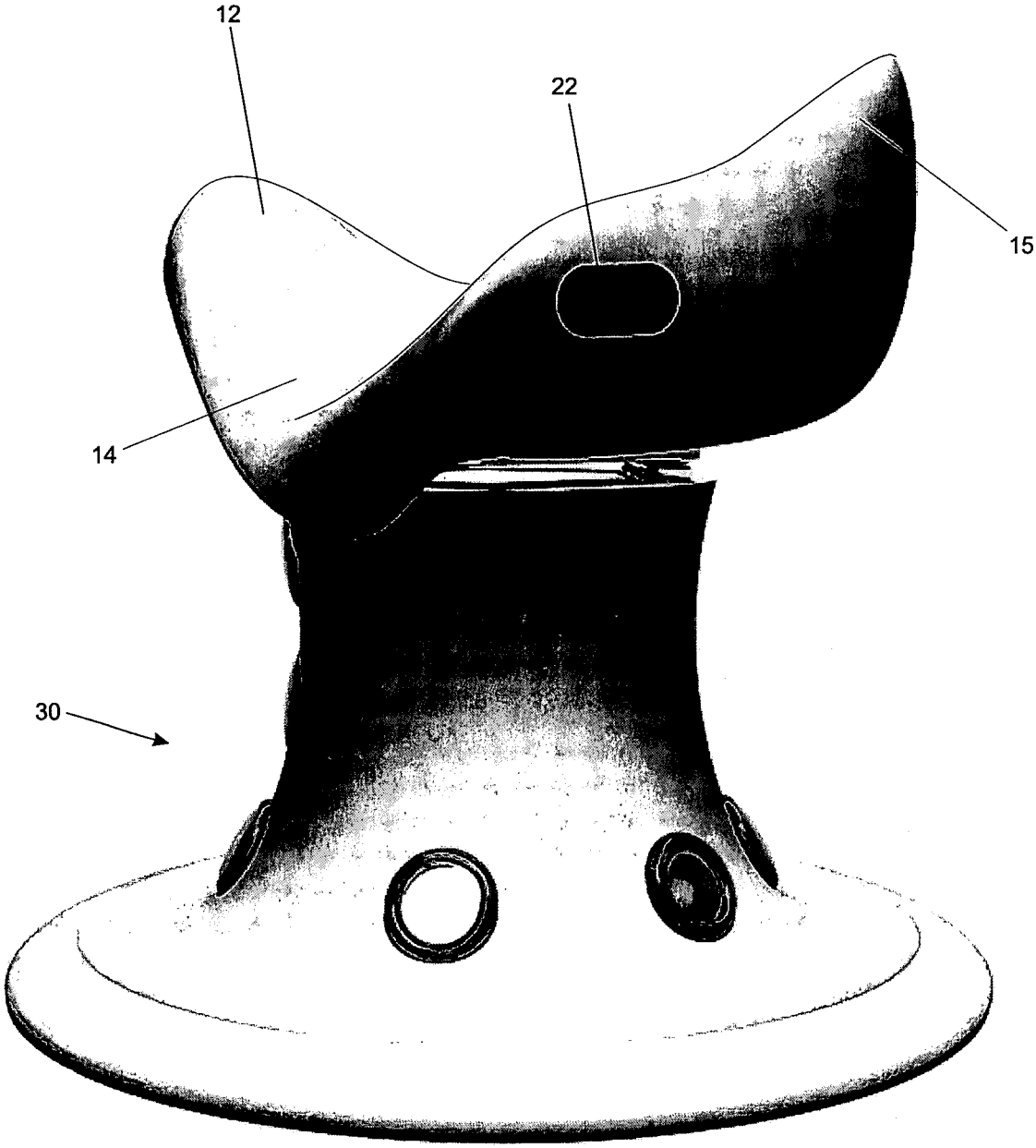
FIG. 2 shows a side view of the seat of FIG. 1 in accordance with a first embodiment of the present invention.

FIGS. 1 and 2 show an embodiment of the seat. The seat comprises a base, or pedestal, section 30 and a seat section 10 which is generally in the form of a saddle. A linkage 40 connects the saddle 10 to the base 30.

The base 30 provides a stable support for the seat. In the illustrated embodiment the lowermost, floor-engaging, foot of the base 30 has a diameter slightly larger than the diameter of the saddle 10. A vertical column 32 connects the foot 31 to the linkage 40. Lights 33 are mounted within the column 32 of the base. The lights can take many different forms, such as single colour lights, multi-colour arrays, such as clusters of LEDs which can be controlled to output a range of different colours or a coherent light source (e.g. laser). By forming column 32 as a hollow structure, the interior space within the column 32 can be used to accommodate electrical and electronic equipment of the apparatus.

Figure 3:
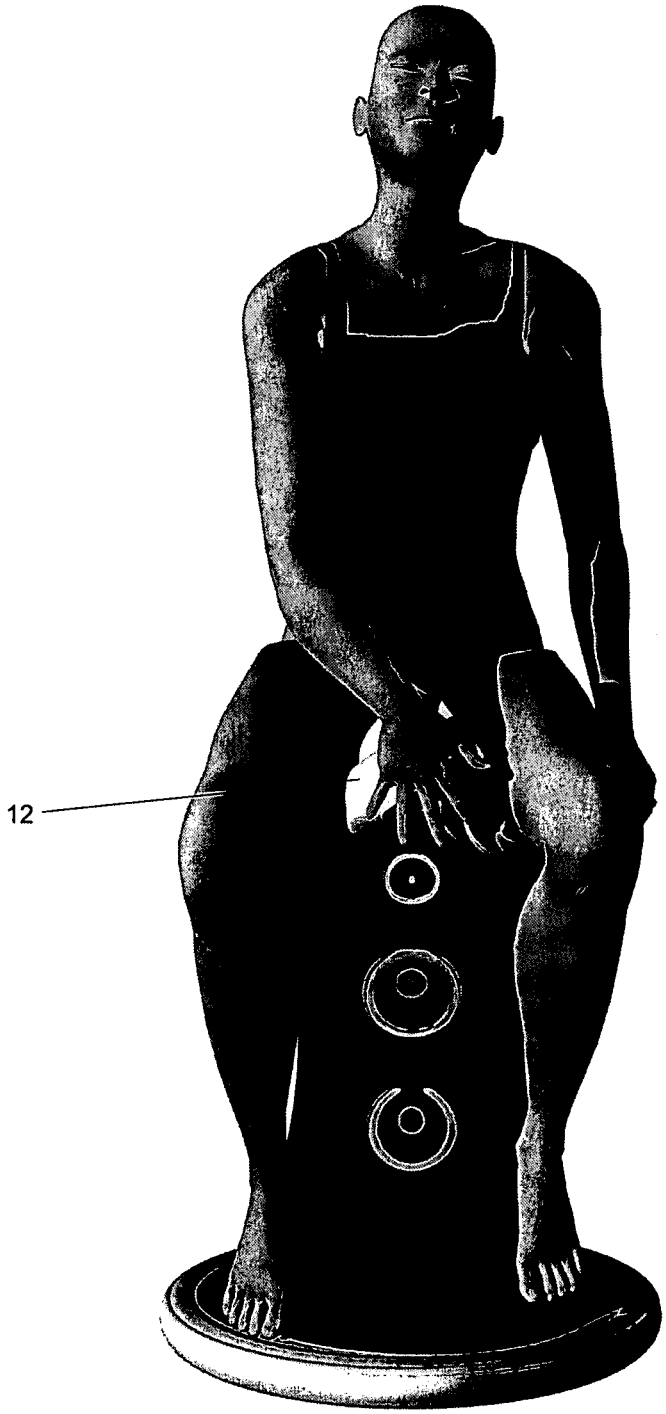
FIG. 3 shows the seat in use.

The saddle 10 is shaped to define a seating area 11 to support a user. To the rear of the seating area 11 is a raised portion 15 which provides support for a user (especially to the base of the back of a user), and serves to prevent a user from shifting too far backwards in the saddle 10. The raised portion 15 extends around approximately 50% of the periphery of the seating area 11. A nodule, promontory, 12 is positioned along the central axis of the saddle 10, at the front face of the saddle 10. The nodule 12 extends above the level of the seating area 11 and serves to define a forward stop for a seated occupant. As best seen in FIG. 2, the upper surface of the nodule 12 rises towards the front face of the saddle 10. A recess 13, 14 is defined between each side of the nodule 12 and the raised portion 15 and defines a space where a user can position their thighs. The nodule 12 serves to guide a user into a seated position in which their thighs are positioned in the recesses 13, 14. The nodule 12 has a curved outer surface to avoid any discomfort to a user. When viewed from above, the nodule can have a generally triangular, oval or circular shape, which further helps to guide a user into the seated position. The nodule 12 can have a further use in providing stimulation to a seated occupant. It can be seen that the nodule 12 helps to ensure that the region in front of the nodule 12 is unobstructed by the seated occupant's legs. A sensor 21 is positioned in the front face of the saddle 10, within the nodule 12, for sensing movement in the region in front of the nodule 12. FIG. 3 shows a user on the seat 5. In use, the rear of a user is supported by the raised portion 15 and the inner thighs/groin area of a user press against the nodule 12. The user is shown moving their hand in front of sensor 21 to manipulate their personal experience.

FIG. 2 shows a side view of the seat 5. A further sensor 22 is positioned on the side of the saddle 10 and is arranged to sense movement in a region to the side of the saddle 10. Conveniently, the sensing region is where a user's hands will naturally rest and this allows a user to use their hands to control lighting and/or sound effects. A similar sensor (not shown) is positioned on the other side of the saddle 10.

Figure 4:
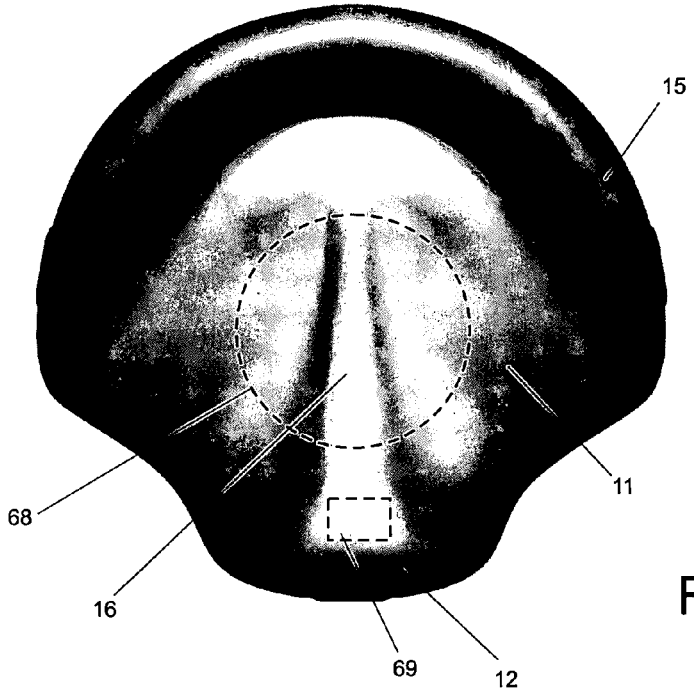
FIG. 4 shows a top view of the saddle of the seat in more detail.

FIG. 4 shows a top view of the saddle 10. A vibro-acoustic transducer is mounted within the saddle. This kind of transducer has a frequency response which extends upwards from a very low level. The transducer will transmit a portion of the generated energy as vibratory (tactile) energy, which is transmitted by contact between the seat and the body of the seated user, and another portion of the energy will be transmitted as acoustic energy, which is transmitted acoustically through the air to the ears of a user. Typical frequency ranges for a vibro-acoustic transducer are 15-800 Hz transmitted in a tactile manner, 35 Hz-17 kHz transmitted acoustically. Of course, these values are not to be taken as limiting in any way. Mounting the transducer within the saddle has the effect that at least some of the sound generated by the transducer is transmitted to the seated user in a tactile manner, i.e. by contact, rather than via the user's ears. Of course, some of the sound will be delivered in a conventional acoustic manner, particularly sound in the mid and higher frequency ranges. Physical features on the upper face of the saddle 10 help to transmit vibratory energy to a seated user, in a tactile manner. A ridge 16 along the central (front-to-back) axis of the seating region 11 of the saddle 10 helps to transmit vibratory energy to a seated user. A user can press or rub against the nodule 12. Preferably, the surface of the seating region 11 of the saddle 10 is sufficiently soft to be comfortable to a user, without being too soft that the vibro-acoustic energy is dampened to a significant extent. The surface of the seating region 11 can be formed of, or overlaid with, a material which is less dense than the seat surface, such as a gel-like material, leather, or other material. The material need only be applied in limited areas, such as where the buttocks of a user will rest.

Figure 5:
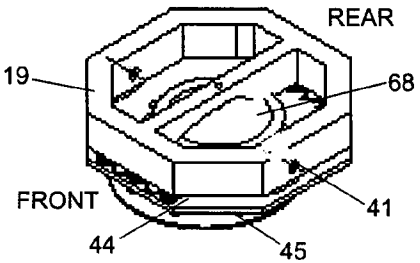
FIG. 5 shows the linkage between the saddle and base of the seat.
Figure 6A:
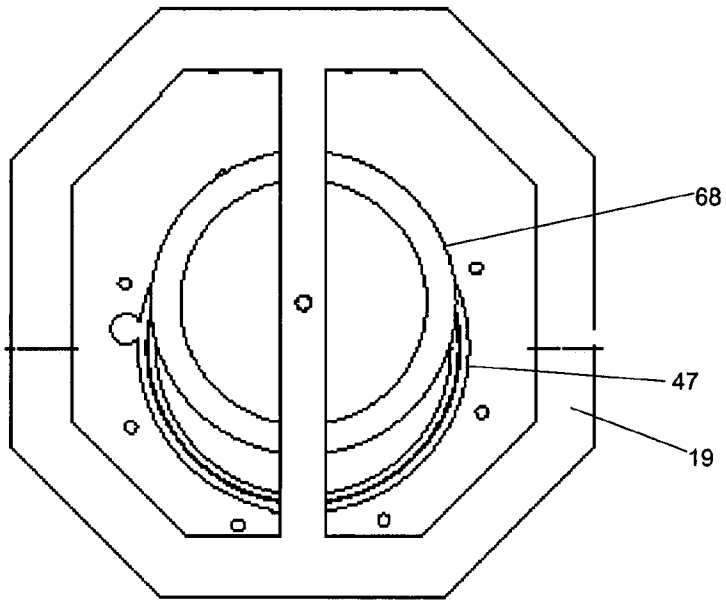
FIGS. 6A and 6B show further view of the linkage between the saddle and base of the seat.
Figure 6B:
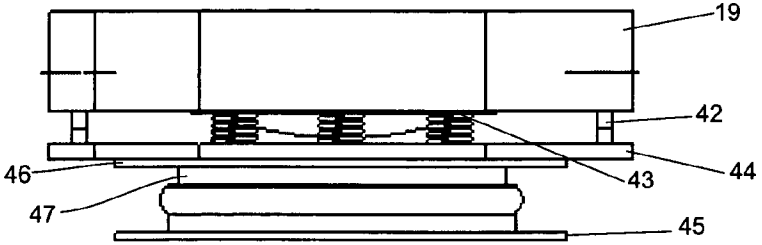

FIG. 5 and FIGS. 6A, 6B show shows details of the linkage 40 between the base 30 and saddle 10. The shaped outer structure of the saddle 10 is formed around a frame 19. The linkage 40 allows the frame 19 of the saddle 10 to rotate (swivel) about a vertical axis and to tilt backwards and forwards about a horizontally-aligned axis. The frame 19 is mounted about two horizontal pivots 41 to the left and right of the central axis placed so that the seat pivots approximately in line with the centre of gravity of the user. The pivots 41 are supported by brackets 42 mounted to a plate 44. Plate 44 is connected to an upper (movable) part of a slew bearing 45, 46 which allows the saddle 10 to rotate about a vertically-aligned axis. The lower part 46 of the slew bearing is fixed to base 30. A set of springs 43 are fitted between the underside of frame 19 and the top surface of upper plate 44 along the edges of the frame 19 that are spaced from pivot points 41. In use, when a user shifts forwards and backwards on the saddle 10, frame 19 rocks about pivots 41 and the rocking movement is dampened by springs 43.

The use of a slew bearing 45, 46, 47 has a number of advantages over other means of providing rotation about a central vertical axis. Firstly, it is able to handle wide variations in loading and the angle and magnitude of any applied vertical force and these forces are distributed over a large bearing surface. Secondly, the central void within casing 47 of the slew bearing allows electrical cables to pass through to the seat, which are required to supply the audio signal to the vibro-acoustic transducer 68 and to carry signals between the sensors 21-23 mounted on the saddle 10 and a control unit mounted in the base 30. The transducer 68 is mounted within, or beneath, the interior volume of the saddle 10 and, in use, causes the shell of the saddle to vibrate (resonate). It is desirable that the transducer 68 can rotate and tilt with the saddle 10.

The tilt and rotation of the seat are limited by stops which are damped by suitable material, such as high-density rubber. An example range of rotation of the seat is 90 degrees in total, with 45 degrees in each direction. Springs (not shown) are provided to restore the slew bearing to a resting position. The central void in the slew bearing also allows for equipment mounted on the underside of the saddle 10, including the transducer 68, to be located beneath the saddle without adding to the overall height of the seat. This has the advantage of keeping the tilt and rotate mechanism compact. For clarity, in FIG. 6A the transducer 68 is shown removed from the interior of the slew bearing housing 47 but, when assembled, is mounted within the interior of the housing 47.

Sensors can be fitted to the components of linkage 40 to separately detect rocking movement and rotational movement of the saddle. Outputs of these sensors can be used to control audio or lighting effects, or other functions.

The linkage 40 described above has been found to offer good tactile/acoustic performance, being sufficiently lacking in stiffness to allow energy to be radiated from the saddle rather than being absorbed by the base 30 and also allowing energy to be radiated evenly from the saddle.

Figure 7:
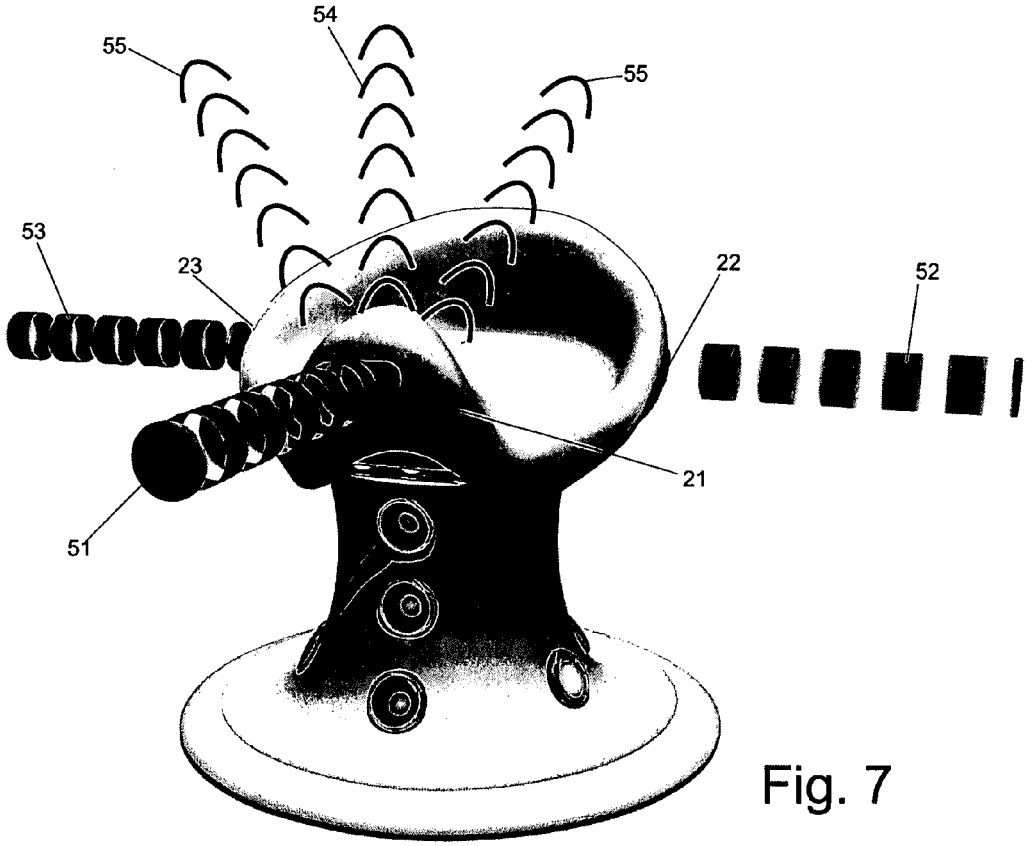
FIG. 7 shows position of sensor beams of the seat.

FIG. 7 schematically shows sensing regions around the seat 5. A first sensing region 51 extends outwardly from sensor 21, in the region in front of nodule 12. FIG. 3 shows the occupant using their hands, in this sensing region 51, to control effects as previously described. A second sensing region 52 extends outwardly from sensor 22, in the region to the left-hand side of saddle 10. A third sensing region 53 extends outwardly from sensor 23, in the region to the right-hand side of saddle 10. Further sensors can be provided on the nodule to sense in a region facing upwards. FIG. 7 shows a vertically-aligned sensing region 54 and two diagonally-directed sensing regions 55. The regions 54, 55 could be combined into a single broad sensing region or used separately to control different effects.

Preferably, sensors 21-23 are placed such that their beam cones are aligned to the expected motion of the user. So, for example, the sensors 22, 23 on the sides of the saddle 10 are angled slightly upwards because the natural swing of the user's arm raises the hand as the user moves their hand further away from the sensor. It will be understood that sensor regions can differ from those shown in FIG. 7.

Sensors 21-23 can use ultrasonic, infra-red, or any other sensing technology. It is preferred that the sensor comprises both a source for radiating a beam of energy (e.g. ultrasonic energy, or infra-red radiation) and a sensing element for detecting energy reflected from an object positioned within the beam. Typically, the source and sensing element are co-located or located directly adjacent one another in a single physical package. Various known techniques can be used to determine, based on reflected energy, the distance of the object from the sensor. These sensors typically work with a fixed beam angle with a beam of approximately circular cross-section, or collections of such beams arrayed to cover a larger area. The active region of a sensor can thus be approximated to a cone of given solid angle, or an array of such cones. The individual beam angles vary with different sensors and different sensor types.

Figure 8:
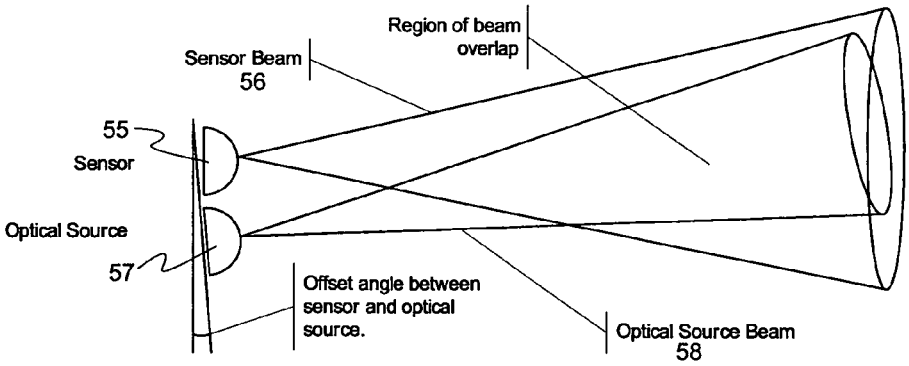
FIG. 8 shows the use of a visible marker beam to mark the position of an invisible sensor beam.

Ultrasonic and infra-red beams are invisible to a user. A user cannot typically perceive these beams or easily judge where they are in the space around the unit. Given that the function of the device depends on the user being able to detect and place objects in the axis of these beams it is helpful to indicate the location of these beams to the user by illuminating them with an optical source. This is shown in FIG. 8. An optical source 57 is designed so that it has a conic section 58 approximately the same, and optionally smaller, than the conic approximation of the sensor beam 56 from a sensor 55. It is likely that it will be mechanically impossible to co-locate the optical source 57 and the sensor 55 and so the optical indicator beam 58 is aligned or angled such that it is as coincident with the sensor beam 56 as much as possible. The user can then detect the sensor beam location 56 by observing the scattered reflection of the matching optical beam 58 from the object obstructing the sensor. Advantageously, the optical beam 58 is narrower than the sensor beam 56 so as to guide the user towards the central part of the sensor beam 56, allowing them to track up and down the beam more accurately, and to compensate for the difference in the axes of the marker beam 58 and sensor beam 56.

Figure 9:
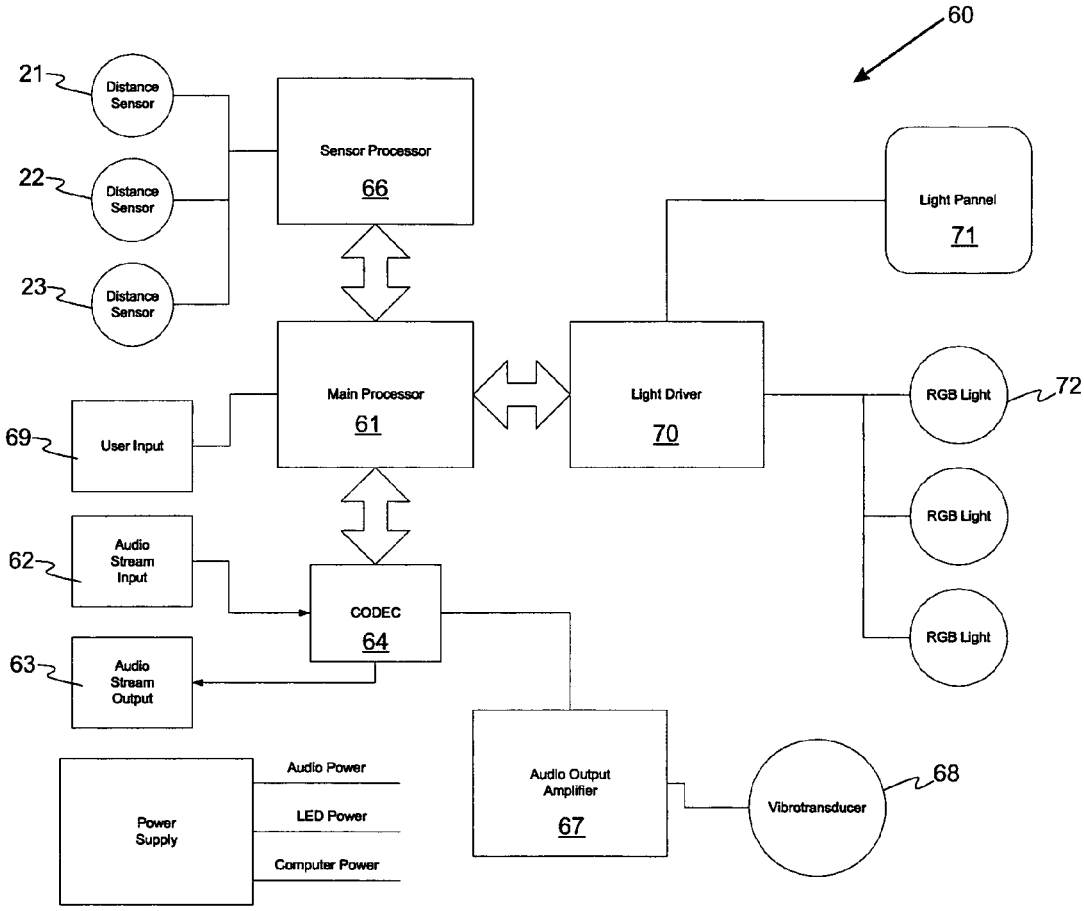
FIG. 9 shows a control unit for the seat.

FIG. 9 schematically shows the control unit 60 for the seat. The control unit 60 receives an audio signal, processes the audio signal based on sensor inputs, and provides a processed audio output. Lighting effects can also be controlled based on sensor inputs. An audio signal 62 can be provided by a local media source (e.g. hard-disk or solid-state store, MP3 player, CD player, DVD player or it can be provided by an external source, such as a DJ's mixing desk, live audio from the audio mixing desk of a band presenting a live performance. For an external source, the audio signal can be delivered to the control unit by a wired or a wireless connection. Any wireless stream is converted to a baseband audio signal before any further processing is carried out. The audio signal is digitised in the CODEC 64 and the stream of digitised data is sent to the main processing unit 61. This processing unit is fast enough to be able to pass this stream of data through a collection of digital processing elements implemented in software or hardware within the processing unit. The parameters of these digital processing elements are controlled substantially, or in part, by the processed output from the sensors 21, 22, 23. Additional sensors can be located elsewhere in the environment around the seat. The resultant processed audio stream is then passed back to the CODEC 64 to be turned into an analogue audio signal that is fed to the audio output amplifier 67 and the vibro-transducer 68. Optionally, the processed audio signal can also be output from the system as a processed audio stream 63. The input and/or output audio streams can be mono, stereo or multi-channel.

A sensor processor 66 examines the state of each of the sensors 21-23 connected to it. The number of sensors can vary from that shown here, and can be just a single sensor or a larger collection of sensors, including sensors which detect other parameters, such as movement of the saddle with respect to the base of the seat. It is also possible that each sensor may be composed of a number of discrete sensing elements whose output is amalgamated by some combination algorithm to result in a single processed value for the parameter being sensed. Typically these sensors sense the distance of an object from them but may optionally comprise other types of sensor such as thermal or colour sensors.

Each of the sensors 21-23 typically provides an analogue output signal. The sensor processor 66 digitises the analogue output signal and passes this stream of digitised data to the main processor 61. The main processor 61 then processes this raw sensor information in a number of different ways:

a) processor 61 identifies the presence or absence of an object within the range of the sensor. This can be termed a 'detection event'. The processor 61 determines, using inbuilt knowledge, if the sensor information represents an object that it is desired to detect, such as a person standing within the usable range of the device or a leg, hand or arm of a person. Processor 61 may determine a probability for the detection event, and issue an output when the determined probability exceeds a threshold value. This decision then activates the features of the device.

b) an input from a sensor can provide information about distance of an object from the sensor. Distance can be used to control parameters of the audio and/or lighting processing elements. Distance information may be determined on a continuous basis, and the processing of audio and/or lighting effects can be determined on a continuous basis. In this way, a user moving their hand can continuously vary some aspect of audio, or can vary some aspect of a lighting effect. This will be described in more detail below.

Figure 10:
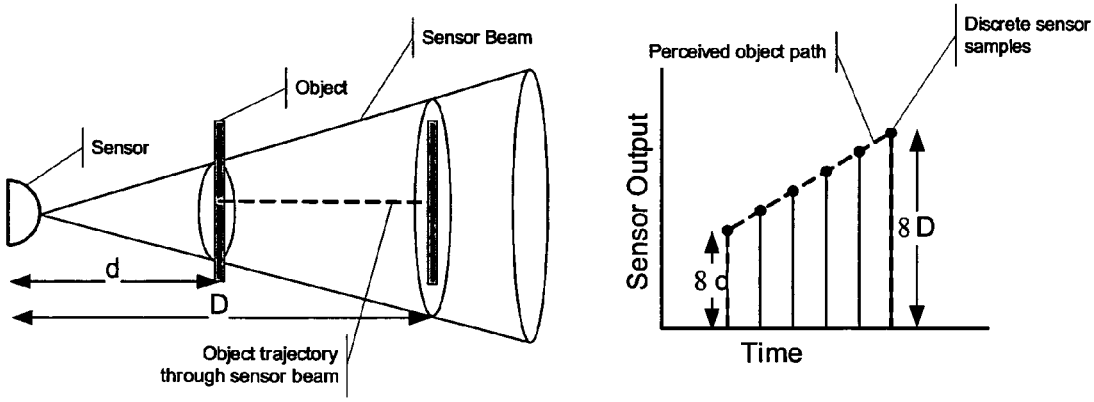
FIG. 10 shows one way of processing an input from a sensor beam.

When a user interrupts a sensor beam within a short finite time the processor 61 measures the distance from the sensor to the position where the beam was interrupted. The user may then move the object within the beam, forwards and backwards along the axis of the beam. This is shown in FIG. 10. The sensor processing element in the system will periodically sample the sensor output to provide readings of the distance of the object from the sensor along the axis of the sensor beam. These samples are then processed to provide a parameter that is proportional to the distance of the object from the sensor, even though the sensor is not necessarily providing a continuous reading. This parameter inside the processing element of the system will vary in approximate proportion to the distance of the object interrupting the sensor beam. This parameter is then passed to the sound or light processing system and used to control an audio or lighting effect. The speed of this processing is sufficiently fast to provide the user with the sensation that the audio or lighting effect is varying continuously with the distance of the object from the sensor. The object will typically be a part of the users body typically a hand or foot, or an item of clothing.

The incoming audio signal may be a mono, stereo or multichannel signal. It is digitised by the CODEC and processed by the main processor. This processing may take a number of different forms. Typically, the processing can be divided into processing the audio input into lighting effects, and the processing of the audio input into an audio output to the vibrotransducer or to local or remote loudspeakers. In each case the audio input signals will be processed using a combination of audio processing modules such as but not limited to filters (e.g. parametric/notched filters), companders, amplifiers, mixers, voltage controlled oscillators, sample and hold units and samplers. The parameters of these different audio processing elements are derived from the output of the sensing system. The audio processing can include the following functions: filtering a frequency band of the audio signal (various bands and curves can be defined); adding a tone to the audio signal; sampling a portion of the audio signal and repeating the sampled portion; phasing/flanging an audio signal; delaying/echoing an audio signal; compressing the dynamic range of the audio; analysing tempo and processing the audio signal using the tempo.

It is possible for a user to activate an audio process that captures a sample from the incoming audio stream. Once captured it is then possible for the given sensor, or optionally another sensor, to be used to replay the stored sample. The mode of replay may depend on the length and type of sample taken. A short sample could be played back using the reading from the playback sensor to vary the number of times per second that the sample is replayed. For longer samples it could be used to vary the parameters of an audio processing effect performed on the sample, for example, a filtration with variable frequency. Alternatively, the sample could be played back when activated by the user, and the user's interaction with the sensors can be used to vary an effect applied to the sample or the rate of the playback.

When capturing and playing back a sample, it is optionally possible to capture the sample in synchronisation with the beat of the music. The audio processing system can continuously monitor the incoming audio stream and issue markers, or events, when beats are detected. A number of well known algorithms exist to achieve this. These markers, or events, would be used by the sampling system to bound the sampling process so that the sampling process automatically captures a whole phrase of the incoming audio signal. It is similarly possible to synchronise the playback of a sample to the incoming beat of the audio stream. In this case the beats detected on the incoming audio stream trigger the playback process. Using a tempo (bpm) analyser, the system predicts/corrects the playback of samples captured so that they are played musically 'in time' with the song's natural rhythm count, either on the beat or off the beat.

The processor can control lighting effects based on sensor inputs. Control of lighting effect can include one or more of: controlling a direction of a light; controlling a colour of a light; controlling an intensity of a light; controlling a beam shape; controlling a projected pattern (e.g. by selecting a gobo to insert in the beam of a light source); controlling a coherent light source to form a shape. Beam direction can be controlled by the use of servo mechanisms.

A further advantageous feature of the apparatus is to generate a low-frequency rumble signal and to output this to the transducer 68 for output as vibratory energy which is transferred in a tactile manner to the seated user. An advantageous frequency range for the rumble signal is 30-160 Hz. The rumble signal can be locally generated by a signal source, independently of any other audio input. The rumble signal can be combined with a (processed) audio signal, with the combined signal being output by transducer 68, or the rumble signal can be output by itself to transducer 68. The rumble effect can be achieved by a low-frequency signal source which is combined with the processed audio signal, or by modulation of the audio signal by a low-frequency signal. Advantageously, the frequency of the rumble signal can be controlled based on inputs from one or more of the sensors on the saddle, so that frequency varies with the sensed position of a user's body part, or another user's presence around the seat.

Processor 61 of the control unit 60 also receives an input from user controls 69. User controls can control parameters such as volume and tone (e.g. bass level or equalisation settings), spectral distribution of generated energy (e.g. amount of vibratory energy, amount of acoustically-generated sound). The user controls can also be used to select an audio track. A display can provide information to a user about current status, or information about the currently selected audio track. A further feature is to provide "male" and "female" user settings. These settings can provide a range of parameters which are tailored to male or female users, such as music selection, volume level, the amount and spectral distribution of energy delivered by the vibro-acoustic transducer 68, etc. User controls 69, and the user display can be mounted in a convenient position on the saddle, such as in the upper face of the nodule 12 or on one of the side faces of the saddle, near to the position where a user's hands will naturally fall.

Figure 11:
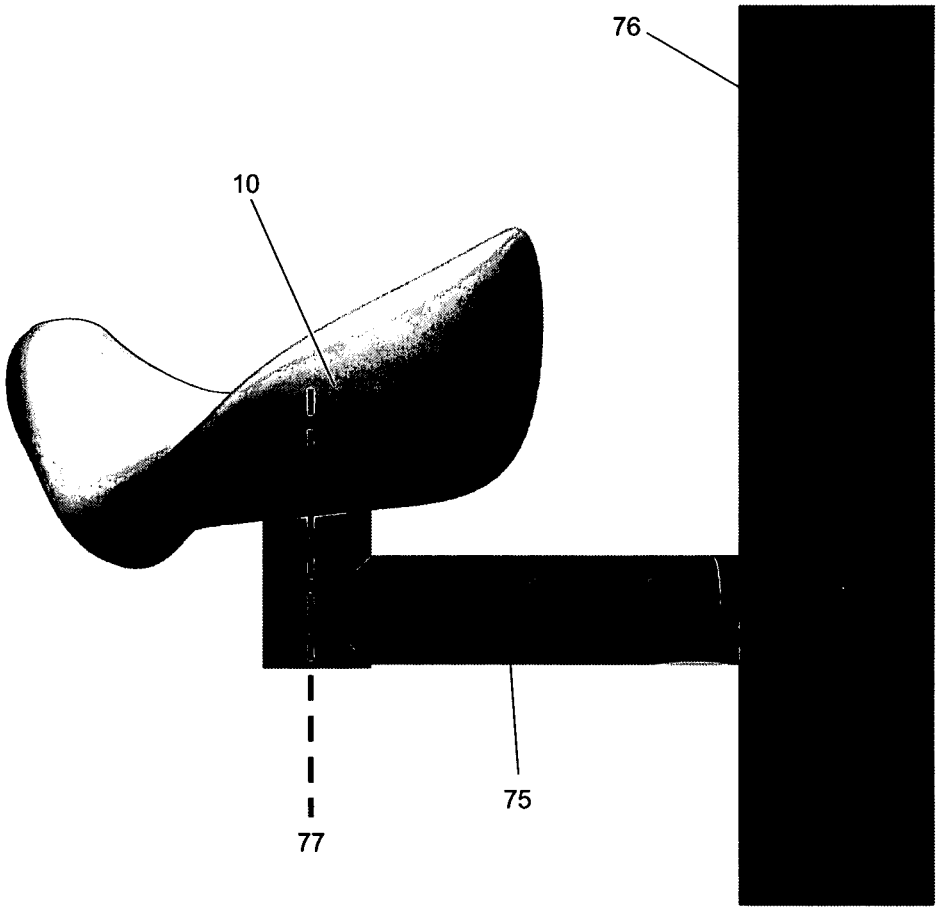
FIG. 11 shows a wall-mounted installation of the seat.

The seat can have a base, as shown in FIGS. 1-3. The base does not need to have the shape shown in FIGS. 1-3, and can take other forms, such as a more slender support column or pillar (seat resembles a bar stool), a support framework, a conventional set of legs, or a sprung support column. FIG. 11 shows a further option, where the saddle 10 is mounted to a wall 76 by a support arm 75. The saddle 10 can be rigidly fixed to the support arm, or it can be mounted via a linkage which allows swivel movement about axis 77. The linkage can also permit tilting movement in a similar manner as shown in FIG. 5 and FIGS. 6A, 6B.

Figure 12:
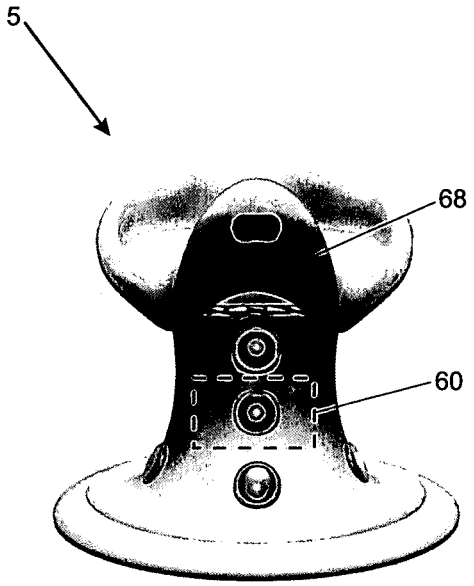
FIG. 12 shows a self-contained embodiment of the seat with an integral control unit and vibro-acoustic transducer.
Figure 13:
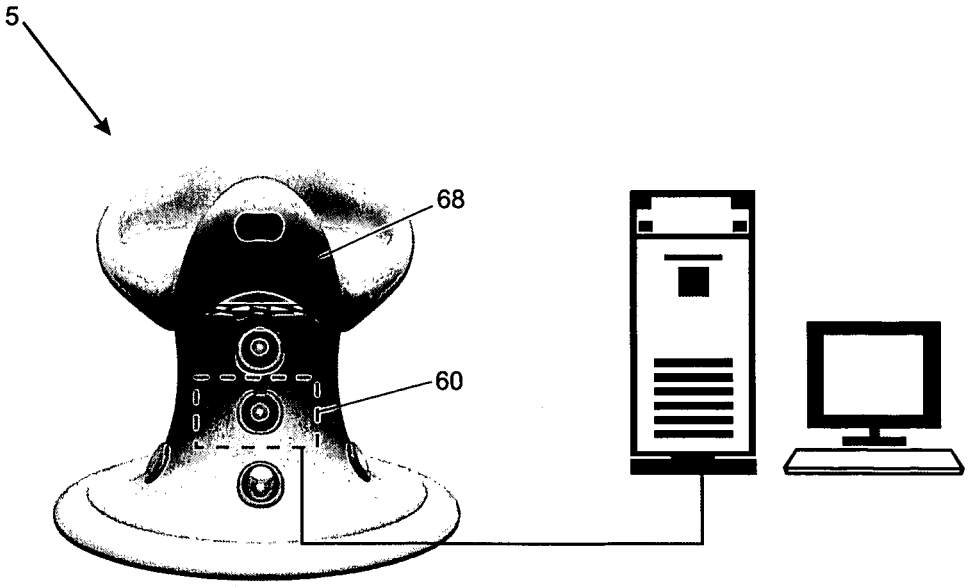
FIG. 13 shows an embodiment in which processing is performed by a PC.
Figure 14:
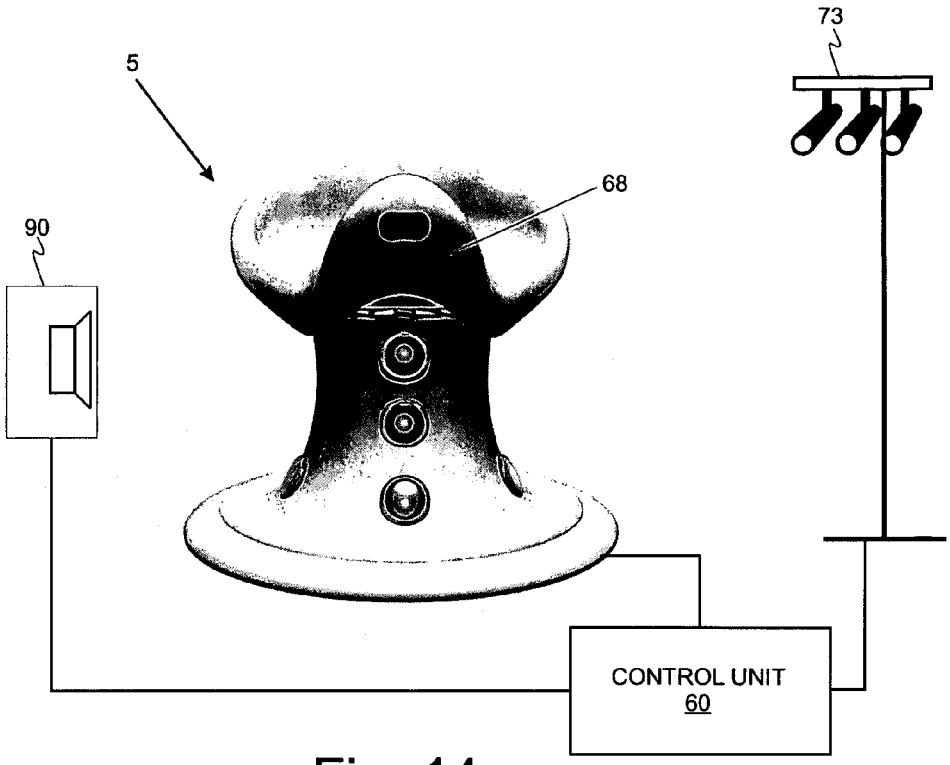
FIG. 14 shows an embodiment of the seat with external control unit.

FIGS. 12-14 show some alternative forms of the seat. A preferred form of the seat 5, shown in FIG. 12, houses the control unit 60 of FIG. 9 in the seat base and has the vibro-acoustic transducer 68 mounted in the saddle 10. The control unit can receive an audio input from an external source or can have an internal audio player.

In FIG. 13 the seat 5 is connected to a personal computer (PC) and functions as a peripheral or accessory for the PC. The PC can provide a source of audio, such as the user's audio collection stored on their PC's hard drive. The PC can also provide many of the processing functions of the control unit 60, such as processing an audio input based on sensor inputs. Software can be provided for installation on the PC to cause the PC's processor to perform the processing. This reduces the amount of processing required in the control unit 60 of the seat. A certain amount of hardware of the control unit 60 is still required in the seat itself. The control unit 60 in the seat can interface with the PC via a standard interface, such as a wired interface (e.g. USB) or a wireless connection.

In FIG. 14, the control unit 60 is positioned externally of the seat, such as in a separate housing. Control unit 60 provides an output to drive a lighting rig 73 which supplements, or replaces, the lights mounted in seat 5. Similarly, control unit 60 provides an audio output to drive a loudspeaker 90 which supplements, or replaces, the transducer 60 mounted in seat 5. In one embodiment, low-frequency content can be delivered to the user as vibratory energy via the transducer 68 within the seat and higher-frequency content can be delivered as acoustic energy to the user via external loudspeaker 90. In a situation where multiple seats 5 are positioned in a single area, a single control unit 60, which is housed within a seat, or externally of a seat, can process audio and generate control outputs on behalf of the multiple seats. Features of the variants shown in FIGS. 12-14 can be combined. For example, any of the variants can have external lights and audio speakers as shown in FIG. 14.

Figure 15:
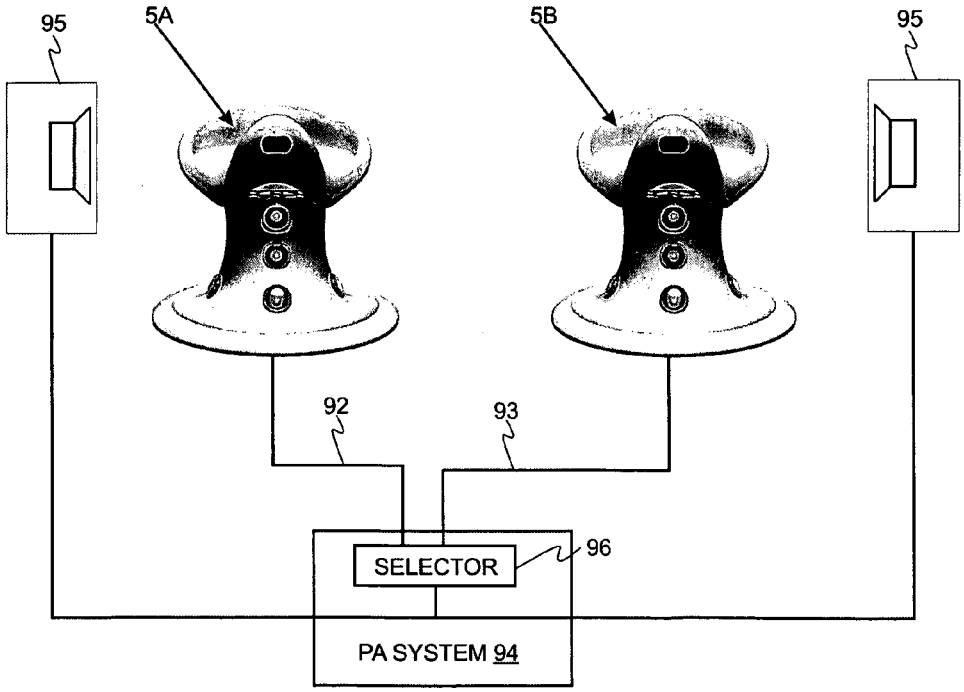
FIG. 15 shows a system with two seats providing audio outputs to an external mixing desk.

FIG. 15 shows a further embodiment of the invention where two seats 5A, 5B are positioned in the same area, such as a club. Processed audio outputs 92, 93 from seats 5A, 5B are output to a PA system, such as a DJ's mixing desk. A selector 96 selects one of the processed audio outputs for distribution to the PA system loudspeakers 95 in the area. In this way, a user can share their "performance" with an audience. As an alternative to processed audio outputs, signals 92, 93 can convey data (raw, or partly processed) from sensors on the seats 5A, 5B and an external control unit can use the sensor information to process an audio feed.

In a further feature, multiple chairs can be linked to one another, to allow the output of one chair to be output to another chair, or multiple chairs. In this way, a user can perform for other seated users.

A further use of the seat described above is as a user interface for mixing channels of audio content. Multiple sensor inputs and/or distance ranges of individual sensors can be separately used to vary gain or other parameters of audio channels. Outputs of the multiple sensors, which represent settings for the multiple channels, can be fed to a multi-channel mixing desk. The audio signal(s) from a multi-channel desk are fed to the inputs of the chair (1 or 2 or all 3 inputs) via inserts across the desk's channels (send and receive) so that the audio signals can be manipulated by the system in the chair (like an external auxiliary piece of outboard equipment) in a studio mixing process or live performance of a band/orchestral group.

The seat described above has three sensors mounted around the periphery of the saddle. It will be appreciated that further sensors can be provided around the seat, e.g. a further sensor could be mounted on the back of the saddle, and the position of the sensors can also be varied from the exact positions illustrated in the drawings.

In the embodiment illustrated in the drawings, the nodule or promontory 12 is a 'hump'-like formation. In alternative embodiments, the nodule 12 can take the form of a narrower structure such as a bar or stump, or it can take the form of a T-shaped structure. The nodule provides a mounting position for a sensor, or sensors, and provides the sensors with an unobstructed field-of-view, especially of the user's hands or arms in the region in front of the user or their lap region.

The invention is not limited to the embodiments described herein, which may be modified or varied without departing from the scope of the invention.

The invention claimed is:

1. An entertainment apparatus comprising:

a seat;

a first sensor mounted on the seat which is arranged to sense the presence of an object, or movement or position of an object in a non-contact manner, within a sensing region around the seat;

a processor arranged to perform at least one of:

receive an audio signal and to process the audio signal based on presence, movement or position detected by the first sensor to provide a processed signal for output to a transducer;

generate the processed signal for output to the transducer based on presence, movement or position detected by the first sensor;

control a lighting effect based on presence, movement or position detected by the first sensor wherein the seat comprises a nodule shaped to cause a user to sit in a position in which their legs are parted around the nodule, and wherein the first sensor is positioned on the nodule and the sensing region of the first sensor includes the region in front of the nodule.

2. The apparatus according to claim 1 further comprising the transducer for generating at least one of: acoustic energy; vibratory energy and wherein the transducer is arranged to receive the processed signal.

3. The apparatus according to claim 2 wherein the transducer is mounted in the seat.

4. The apparatus according to claim 3 wherein the transducer is arranged to transmit vibratory energy to a seated user in a tactile manner.

5. The apparatus according to claim 4 wherein the seat comprises a ridge portion for transmitting vibratory energy to a seated user.

6. The apparatus according to claim 1 wherein the sensing region of the first sensor includes the region above the nodule.

7. The apparatus according to claim 6 further comprising a user interface for allowing a user to control the apparatus which is mounted in the nodule.

8. The apparatus according to claim 1 further comprising at least one further sensor positioned on the seat and wherein the processor is arranged to perform at least one of: process the audio signal and control the lighting effect based on presence, movement or position detected by the further sensor.

9. The apparatus according to claim 8 wherein the further sensor is positioned on a side of the seat and is arranged for sensing in a region to the side of the seat.

10. The apparatus according to claim 9, wherein there is a further sensor positioned on each side of the seat and arranged for sensing in a region to a respective side of the seat.

11. The apparatus according to claim 1 further comprising an audio source for providing the audio signal to the processor.

12. The apparatus according to claim 1 further comprising an input for receiving the audio signal from an audio source externally of the apparatus.

13. The apparatus according to claim 12 wherein the audio signal is received via a wireless link.

14. The apparatus according to claim 1 further comprising an audio output for outputting the processed audio signal externally of the apparatus.

15. The apparatus according to claim 1 further comprising an input for receiving a signal from a source external to the apparatus, the signal from the external source comprising: an audio signal processed by the external source or data for use in processing the audio signal, and wherein the transducer is arranged to selectively use the input from the external source.

16. The apparatus according to claim 1 wherein the processor is operable to process the audio signal by at least one of:

filtering a frequency band of the audio signal;
adding a tone to the audio signal;
sampling a portion of the audio signal and repeating the sampled portion;
phasing/flanging the audio signal;
delaying/echoing the audio signal;
compressing the dynamic range of the audio signal;
analysing tempo of the audio signal and processing the audio signal using the tempo.

17. The apparatus according to claim 1 comprising a light, or light array, and wherein the processor is operable to control the lighting effect by at least one of:

controlling a direction of the light;
controlling a colour of the light;
controlling an intensity of the light;
controlling a beam shape;
controlling a projected pattern;
controlling a coherent light source to form a shape.

18. The apparatus according to claim 17 wherein the light, or light array, is mounted in the seat.

19. The apparatus according to claim 1 wherein the seat comprises a support and a connection which allows the seat to move with respect to the support.

20. The apparatus according to claim 19 wherein the connection permits at least one of: swivel movement; rocking movement.

21. The apparatus according to claim 19 further comprising a seat movement sensor for sensing movement of the seat and wherein the processor is arranged to: process the audio signal or control the lighting effect based on movement detected by the seat movement sensor.

22. The apparatus according to claim 1 wherein the processor is mounted within the seat.

23. The apparatus according to claim 1 wherein the seat comprises a support in the form of one of a base for supporting the seat on a floor and a support member for wall-mounting or mounting to another support structure.

24. The apparatus according to claim 1 wherein the sensor comprises a co-located transmitter and receiver, the transmitter being arranged to provide a beam of energy and the receiver being arranged to detect reflected energy.

25. The apparatus according to claim 1 wherein the apparatus is arranged to provide a range of user-selectable settings.

26. The apparatus according to claim 25 wherein the settings include: a setting for male users and a setting for female users.

* * * * *